US008499582B1

(12) United States Patent
Carter

(10) Patent No.: US 8,499,582 B1
(45) Date of Patent: Aug. 6, 2013

(54) INTERCHANGEABLE JEWELRY STRAND

(76) Inventor: James W. Carter, Albuquerque, NM (US)

( * ) Notice: Subject to any disclaimer, the term of this patent is extended or adjusted under 35 U.S.C. 154(b) by 442 days.

(21) Appl. No.: 11/943,481

(22) Filed: Nov. 20, 2007

Related U.S. Application Data

(60) Provisional application No. 60/860,370, filed on Nov. 20, 2006.

(51) Int. Cl.
*A44C 11/02* (2006.01)

(52) U.S. Cl.
USPC ..... 63/3.1; 29/896.4; 29/896.411

(58) Field of Classification Search
None
See application file for complete search history.

(56) References Cited

U.S. PATENT DOCUMENTS

| | | | | | |
|---|---|---|---|---|---|
| 685,044 | A | | 10/1901 | Haussmann | |
| 792,334 | A | | 6/1905 | Levy | |
| 1,578,461 | A | | 3/1926 | Morris | |
| 1,813,963 | A | * | 7/1931 | Schick | 24/616 |
| 2,266,074 | A | * | 12/1941 | Rauer | 24/616 |
| 2,644,992 | A | * | 7/1953 | McFarland | 24/116 A |
| 3,208,238 | A | * | 9/1965 | Spitzer | 63/3.1 |
| 3,225,406 | A | * | 12/1965 | Levy | 24/616 |
| 4,305,262 | A | | 12/1981 | Ferrara | |
| 4,527,316 | A | * | 7/1985 | Murphy | 24/616 |
| 4,549,411 | A | * | 10/1985 | Ivey | 63/1.16 |
| 4,628,708 | A | * | 12/1986 | Ivey | 63/1.16 |
| 4,651,541 | A | * | 3/1987 | Farley | 63/1.16 |
| 4,879,882 | A | | 11/1989 | Johnson et al. | |
| 5,133,195 | A | | 7/1992 | Appelbaum et al. | |
| 5,375,434 | A | | 12/1994 | Wertheimer et al. | |
| 5,689,867 | A | * | 11/1997 | Katz | 24/587.1 |
| 5,794,459 | A | * | 8/1998 | Ignatowski | 63/38 |
| 5,836,176 | A | | 11/1998 | Lichtenstein et al. | |
| 6,230,961 | B1 | | 5/2001 | Graser | |
| 6,305,386 | B1 | * | 10/2001 | Wochadlo | 132/275 |
| 6,318,122 | B1 | | 11/2001 | Burgard | |
| 6,381,985 | B1 | | 5/2002 | Burgard | |
| 6,438,995 | B1 | * | 8/2002 | Kuptzin et al. | 63/3.1 |
| 6,675,611 | B2 | * | 1/2004 | Hunter | 63/3.1 |
| 7,350,376 | B2 | * | 4/2008 | Couling | 63/3.1 |
| 7,543,460 | B2 | * | 6/2009 | Cruise et al. | 63/21 |
| 7,980,095 | B1 | * | 7/2011 | Masterson | 63/41 |
| 2003/0010057 | A1 | * | 1/2003 | Hunter | 63/3.1 |
| 2003/0141327 | A1 | * | 7/2003 | Cruise et al. | 224/182 |
| 2004/0016261 | A1 | | 1/2004 | Rose | |
| 2004/0194502 | A1 | * | 10/2004 | Ma | 63/3.1 |
| 2009/0151393 | A1 | | 6/2009 | Spigner et al. | |

* cited by examiner

*Primary Examiner* — Jack W. Lavinder
(74) *Attorney, Agent, or Firm* — Deborah A. Peacock; Philip D. Askenazy; Peacock Myers, P.C.

(57) ABSTRACT

A method, apparatus and kit for the construction of jewelry and jewelry systems having interchangeable jewelry strands.

7 Claims, 9 Drawing Sheets

INTERCHANGEABLE JEWELRY STRAND

CROSS-REFERENCE TO RELATED APPLICATIONS

This application claims priority to and the benefit of the filing of U.S. Provisional Patent Application Ser. No. 60/860,370 entitled "Adjustable and Interchangeable Jewelry", filed on Nov. 20, 2006, and the specification and claims thereof are incorporated herein by reference.

COPYRIGHTED MATERIAL

A portion of the disclosure of this patent application Ser. No. 60/860,370 and of the related applications listed above contains material that is subject to copyright protection. The owner has no objection to the facsimile reproduction by anyone of the patent document or the patent disclosure, as it appears in the U.S. Patent and Trademark Office patent file or records, but otherwise reserves all copyrights whatsoever.

BACKGROUND OF THE INVENTION

1. Field of the Invention (Technical Field):

Embodiments of the present invention relate to interchangeable jewelry strands, as well as the manufacture thereof. Particularly, an embodiment of the present invention relates to jewelry and its many forms including but not limited to earrings, necklaces, bracelets, anklets, pendants, pins, broaches, belts, bands and rings, in which strands of gemstones, stones, beads, glass, plastics, metals, and/or other materials are interchangeable with one another and thus enable a user to create unique jewelry forms.

2. Description of Related Art

The wearing of personalized jewelry is very popular. However, the cost of adding a personal touch or personality to jewelry typically requires one to incur the expense of a jewelry designer to create a customized piece of jewelry to an individual's unique specifications. This process is very expensive. There is thus a need for a jewelry invention which allows the individual an easy and desirable method and apparatus for acquiring and wearing personalized, custom jewelry, which can subsequently be reconfigured by the individual. There is further a need for a jewelry invention which offers an individual greater flexibility and easy interchangeability, of any jewelry strands, and combinations of metals and gemstones strands, placed together or separately in any combination within the various jewelry forms, including but not limited to earrings, necklaces, bracelets, anklets, pendants, pins, broaches, belts, bands and rings. Still further, there is also a need for an invention which offers an individual an easy and desirable method for acquiring, selecting and wearing personalized, custom jewelry.

BRIEF SUMMARY OF THE INVENTION

Embodiments of the present invention relate to a method for constructing interchangeable jewelry comprising: providing a bar comprising at least one hoop; disposing a first strand comprising a plurality of beads on the bar via the hoops; and interchanging the first strand, with a second strand.

Alternative embodiments of the interchangeable jewelry can comprise: a necklace, a pendant, a ring, an earring, a belt, a band, and/or a broach and pin.

Embodiments of the present invention comprise at least one bar which preferably comprises a bar with a plurality of hoops and multiple strands on the bar. The strands are removably positionable on the bar with one or more clasps. Alternative embodiments include but are not limited to forming a chain with multiple strands and bars.

Embodiments of the present invention can optionally form a jewelry kit comprising: at least one bar, the bar comprising a plurality of hoops; a plurality of strands, which comprise a plurality of beads and a plurality of clasps for attaching the strands to the hoops. Alternatively, a clasp can be disposed on an end of each strand.

Objects, advantages, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

Figure 1:
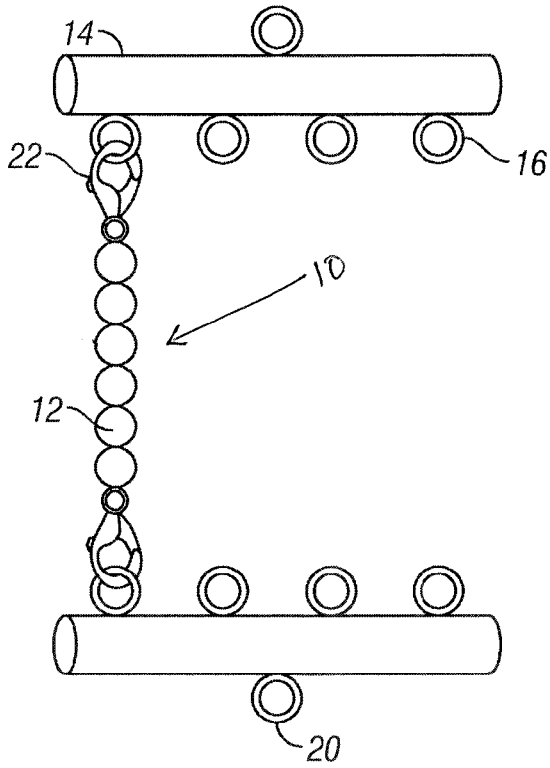
FIG. 1 illustrates the preferred embodiment of the present invention.

Embodiments of the present invention relate to jewelry and the construction of jewelry comprising jewelry strands. Jewelry strands comprise interchangeable standard, precious, semi-precious, synthetic and crystal strands of individual beads or stones and base metal, precious or semi-precious metal or other material strands in any combination, for necklaces, earrings, bracelets, pendants, anklets, pins, broaches, belts, bands, finger rings, toe rings, conchos, and the like. The strands are preferably interchangeable with other jewelry strands by using a simple and easy to operate fastener, such as a clasp, clamp, clip, or the like, disposed at one or more ends of the strands. The fastener allows the various strands to be removed and easily exchanged with other stones and strands as well as with strands comprising combinations of both stones and materials to make the aforementioned jewelry products. Other embodiments of the present invention relate generally to jewelry and more specifically user-adjustable jewelry.

The term "strand" as used throughout the specification and claims means any combination of two or more components connected together included but not limited to chains, filaments, fibers, natural fabrics, synthetic fabrics, metals, beads, stones and the like. The term "beads" as used throughout the specification and claims means any structure or shape of any material of any size which can be used to connect together to form jewelry, and includes but is not limited to traditional beads and stones.

The term "stone" as used throughout the specification and claims means any stone, gemstone, gem, bead, plastic, metal or other element or material used as a decorative jewelry element, placed in a finding or setting.

The terms "clasp", "hoop" and/or "loop" as used throughout the specification and claims means any fastener, fastening system or attachment mechanism which is capable of joining an end. Accordingly, these terms also include, but are not limited to clasps, clips, clamps, snaps, hooks, loops, holes, openings, combinations thereof, and the like. The term "chain" as used throughout the specification and claims is not limited to only metal chain configurations. Rather, the term "chain" can include any elongated structure which can be used for or with jewelry, including but not limited to: chains, ropes, cables, strings, straps, belts, wires, combinations thereof, and the like, made from any material or combination of materials. In addition, a "chain" can optionally include any of the previously described structures threaded through one or more decorative elements.

The term "bar" means any tube, solid piece, flat piece or component to which strands can be attached directly or via a hoop.

Although this application mentions specific colors or materials, such reference only constitutes a preferred embodiment of the present invention. Any colors or materials can be substituted and will provide desirable results. Those skilled in the art will readily recognize that various other colors and/or materials can be substituted.

Any packaging program or jewelry set assists an individual in storing and selecting the multiple combinations of jewelry strands, colors, shapes and sizes. A large array of different jewelry combinations, throughout the various jewelry forms (including but not limited to earrings, necklaces bracelets, anklets, pendants, broaches, pins, finger rings, toe rings, etc.) by the present invention are available for the individual to select and create. The term "jewelry" as used throughout the specification and claims is intended to include all such forms.

An easy method to accomplish this is also provided by the present invention.

Referring now to the figures, FIG. 1 illustrates custom strands 10 which can comprise any size, shape, color, material, or combinations thereof which are preferably used to form aesthetically pleasing jewelry and ornamentation for an individual. Custom strands 10 preferably comprise one or more beads 12 preferably attached together. Custom strands 10 are more preferably disposed on one or more bars 14. In this embodiment, a plurality of custom strands 10 can be disposed on bar 14, and the plurality of custom strands 10 are thus interchangeably positionable by a user to form virtually any type of jewelry. Bars 14 most preferably comprise at least one hoop 16. As those skilled in the art will readily recognize upon studying this application, beads 12 can comprise numerous dimensions and/or shapes while still achieving desirable results. Bars 14 can optionally contain decorative elements or inscriptions.

Figure 2A:
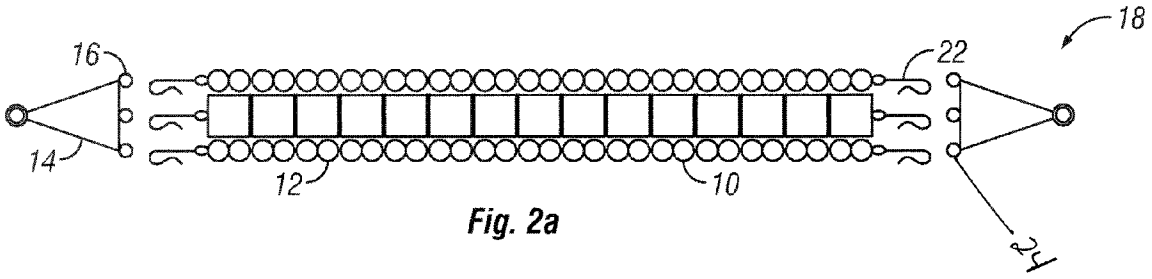
FIGS. 2*a* and *b* illustrate alternative bracelet/anklet embodiments of the present invention.
Figure 2B:
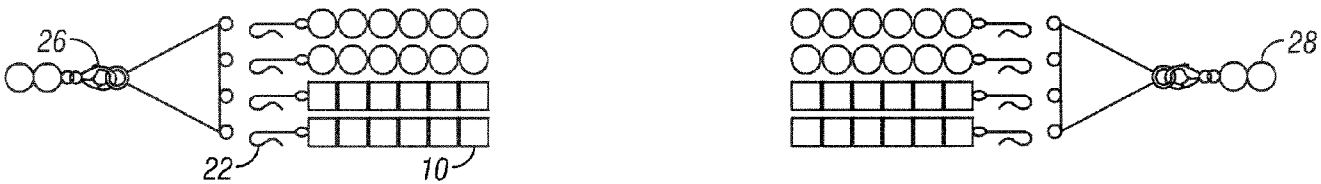

One or more custom strands 10 can optionally be placed onto bars 14, which can be virtually any length, allowing multiple combinations of custom strands 10 to be provided in numerous sizes and shapes, to form any type of jewelry. FIGS. 2*a* and *b* illustrate bracelet 18 of the present invention with various shapes of beads 12. Preferably, custom bracelet/anklet 18 comprises one or more strands 10 disposed on at least one bar 14. A plurality of strands 10 are more preferably used for each bracelet/anklet embodiment. Bracelet/anklet 18 optionally comprises at least one hoop 16 on bars 14 and at least one connecting hoop 24 at a terminal end. Clasp 22 can optionally be disposed on each end of interchangeable strands 10. Connecting clasp 26 is preferably disposed on one terminal end of interchangeable bracelet/anklet 18, and extender chain 28 is optionally disposed on an end of bracelet/anklet 18, which can be decorative or can allow for different needs in jewelry length and style. Strands 10 preferably attach to bars 14 with one or more hoops 12 and or clasps 22. One or more custom strands 10 can be disposed on bar 14.

Figure 3A:
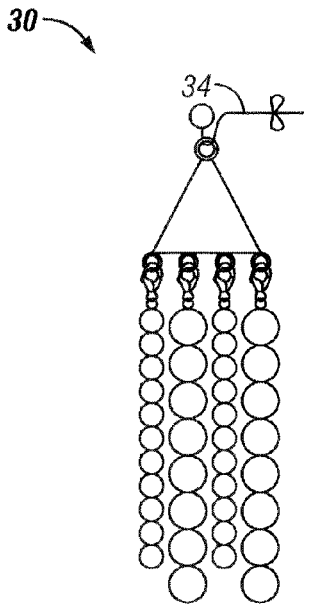
FIGS. 3*a* and 3*b* illustrate alternative earring jewelry embodiments of the present invention.
Figure 3B:
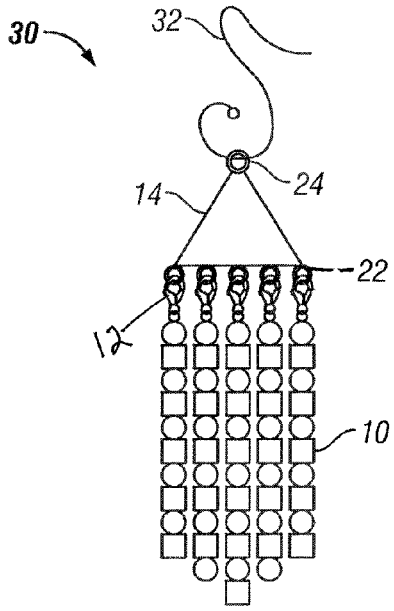

FIGS. 3*a* and *b* illustrate alternative earring 30 configurations constructed from bars 14 and one or more custom strands 10 comprising beads 12. Each custom earring 30 comprises at least one bar 14. Strands 10 are preferably easily positionable, removable and/or attachable to hoops 12 by clasps 22. At a first end of bars 14 hoop 24 is optionally disposed. Hoop 24 allows the attachment of pierced ear insert 32 and/or ear stud 34 for placement in a pierced ear. Alternatively, a clip insert (not shown) may be attached to hoop 24 or directly to bar 14 for attachment to a non-pierced ear.

Strands 10 can be any length to achieve a particular effect. Strands 10 preferably attach to bars 14 through any manner, method or apparatus known to those skilled in the art. Earring 30 can optionally be used to attach jewelry to a body part of an individual and/or help to form an ornamental portion of the jewelry piece.

For embodiments of the present invention comprising a plurality of strands 10 disposed on bars 14, strands 10 are preferably disposed adjacent to one another. Bars 14 can optionally accept any number of custom jewelry strands 10 depending on the size of the strands and length of the bar. Strands 10, in other embodiments, can be intertwined, braided, be of different lengths, or otherwise situated on bars 14 according to an individual's preference. In an alternative embodiment, both ends of strands 10 can be connected to the same bar 14 to form interchangeable hanging hoops.

Figure 4:
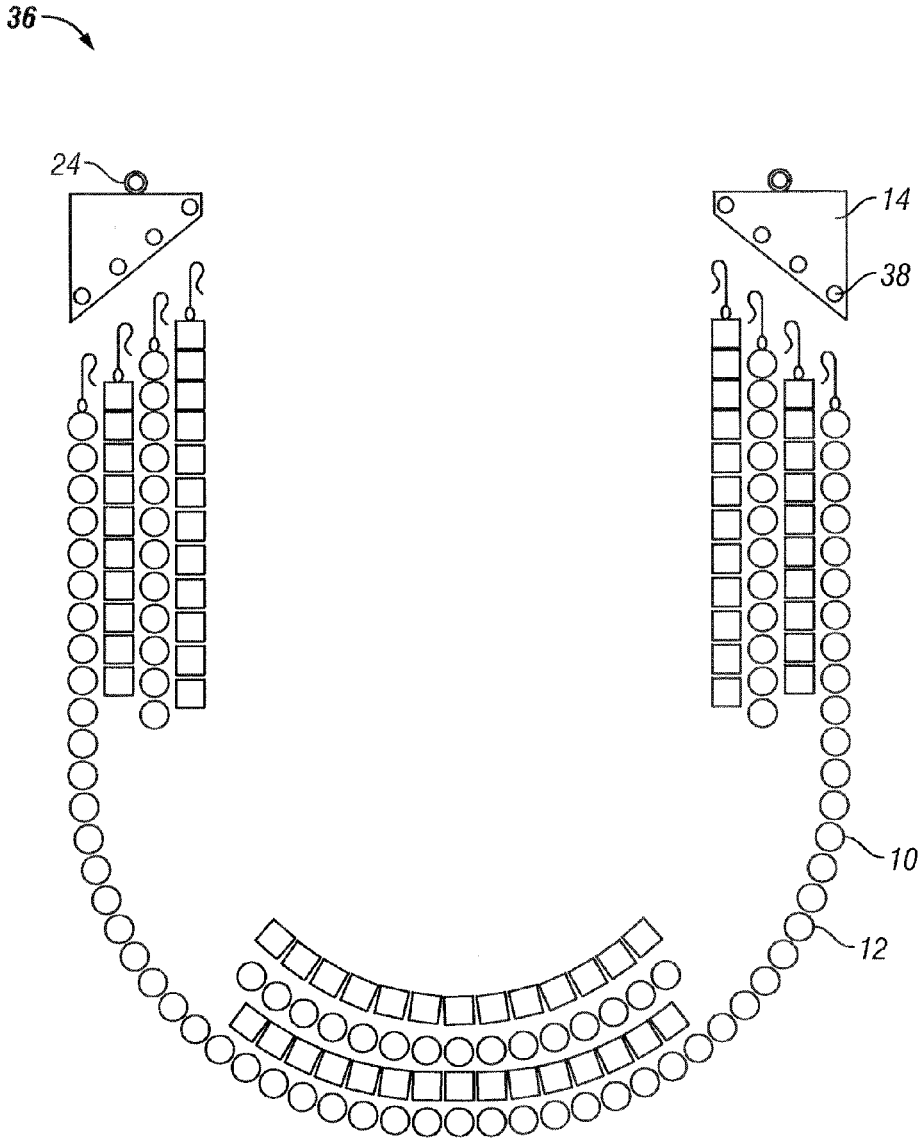
FIG. 4 illustrates alternative necklace embodiments of the present invention.

FIG. 4 illustrates necklace 36 of the present invention wherein disposed on bars 14, are a plurality of hoops 38 which optionally allow for the attachment of at least one strand 10.

Referring now to FIG. 4, finished necklace 36 is illustrated with two bars 14 and a plurality of custom strands 10. Bars 14 preferably have hoops 24 or clasps disposed at terminal ends thereof. Of course hoops 24 are or can be replaced by any fastening method capable of connecting any known jewelry components.

Figure 5A:
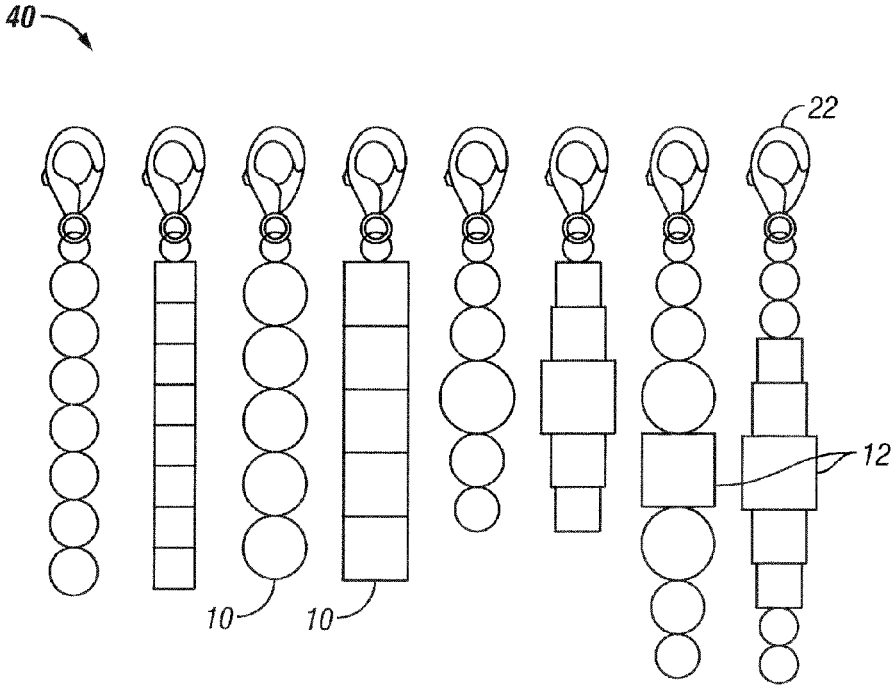
FIGS. 5*a* and *b* illustrate alternative pendant/pin embodiments of the present invention.
Figure 5B:
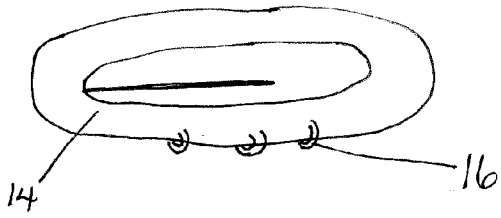

FIGS. 5*a* and 5*b* illustrate an embodiment of jewelry 40 which preferably comprises bars 14 with one or more strands 10 disposed thereon via clasps 22. FIG. 5*a* illustrates different embodiments of strands 10 used for pendant 40. Alternatively a clasp can be disposed on a terminal end of strand 10 and can be a decorative element and/or can be used to attach an additional decorative element.

FIG. 5*b* illustrates jewelry (e.g. pendant/broach/pin) which optionally comprises multiple hoops 16 and wherein a sharp implement is preferably disposed on the back of jewelry 42 to position and/or secure it to any clothing an individual chooses.

Figure 6:
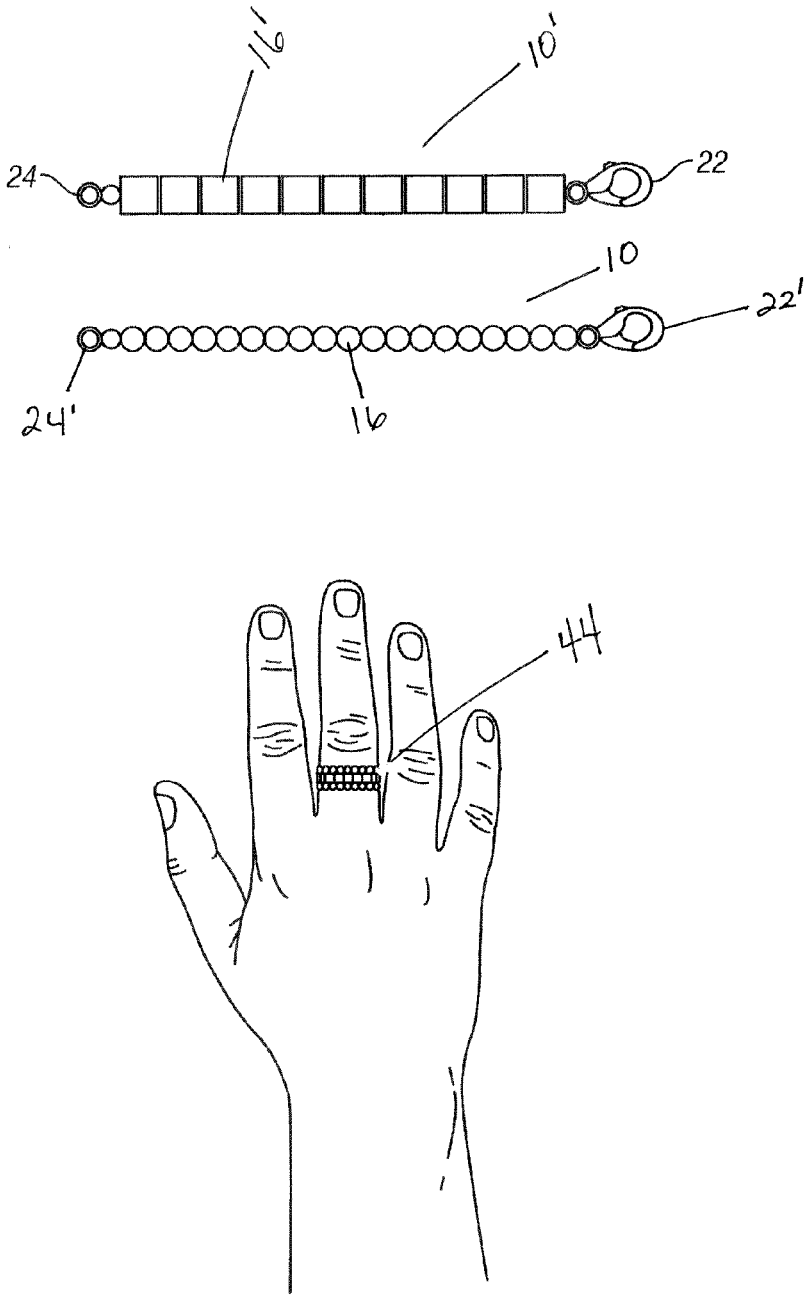
FIG. 6 illustrates alternative ring embodiments of the present invention.

FIG. 6 illustrates ring 44 comprising strands 10, 10' with beads 16, 16' clasps 22, 22' and hoops 24, 24'. In this embodiment, strands 10 can optionally be strung with materials that stretch. Strands 10 can therefore stretch to accommodate any ring size. The strands 10, 10' may be disposed adjacent to each other to form ring 44.

Figure 7:
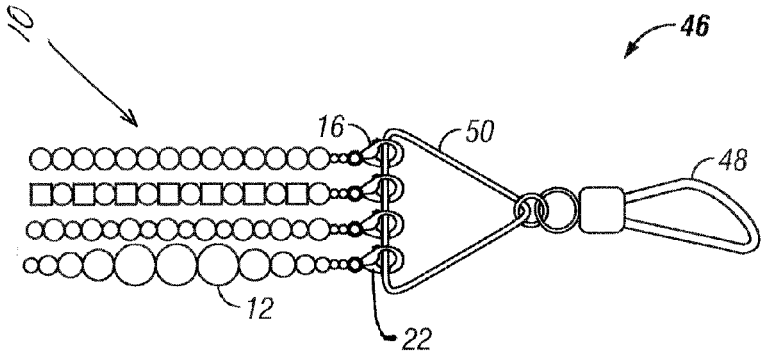
FIG. 7 illustrates alternative belt look dangles embodiment of the present invention.

FIG. 7 illustrates belt loop dangles 46 which preferably comprise decorative clasp 48 disposed on decorative bar 50, which optionally comes in different sizes and shapes. Decorative clasp 48 and/or bar 50 thus alternatively make up a belt loop. Strands 10 are preferably disposed on, added to or removed from decorative bar 50 via clasps 22 disposed at a terminal end of strands 10.

Figure 8:
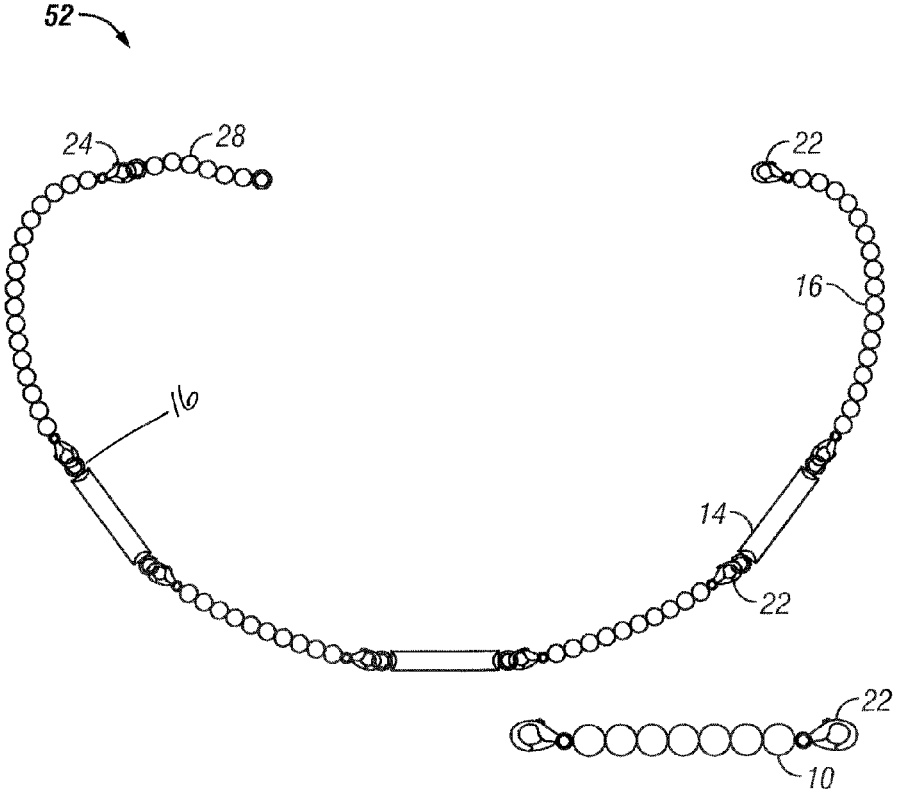
FIG. 8 illustrates an alternative hatband embodiments of the present invention.
Figure 9:
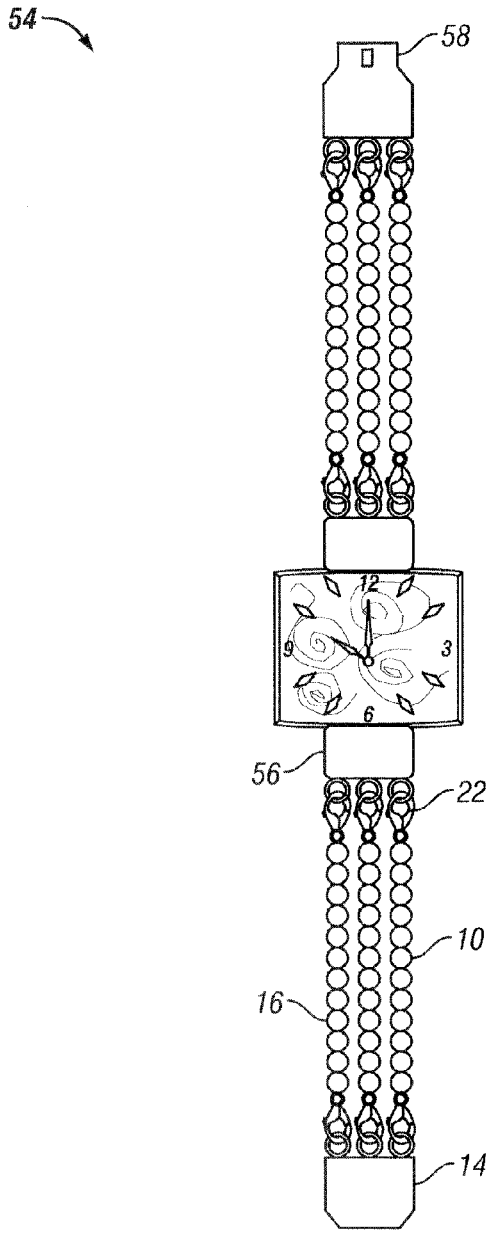
FIG. 9 illustrates a watchband embodiment of the present invention.

FIGS. 8 and 9 illustrate alternative embodiments of bands. Hatband 52 (FIG. 8) comprises wherein strands 10 strung in series with bars 14 between strands 10. Hatband 52 preferably has hoops 16 disposed on one end and more preferably clasps 22 on another end, which allow for the easy attachment of interchangeable strands 10. Hatband 52 optionally has extender chain 28 on a terminal end, and decorative clasp 26 on another end of hatband 52.

Watchband 54 (FIG. 9) comprises multiple strands 10 disposed on bars 14 attached on one end to a timepiece and clasp 56 on a terminal end. Each custom band of the present invention preferably comes in any size or material as is known to one skilled in the art. Watchband 54 (FIG. 9) preferably comprises watch bar 56 disposed on a timepiece via a spring clasp (not shown) on one end. Strands 10 are preferably disposed on or between watch bar 56 and bars 14 with clasps 22 preferably located on each end of strands 10. Bars 14 are optionally finished with box clasp 58 or any other appropriate closing member.

Alternative embodiments of bands 12 are optionally comprised of other materials including but not limited to metal, metal alloy, leather, synthetic leather, vinyl, plastic, synthetic materials, other materials or any combination thereof.

Figure 10A:
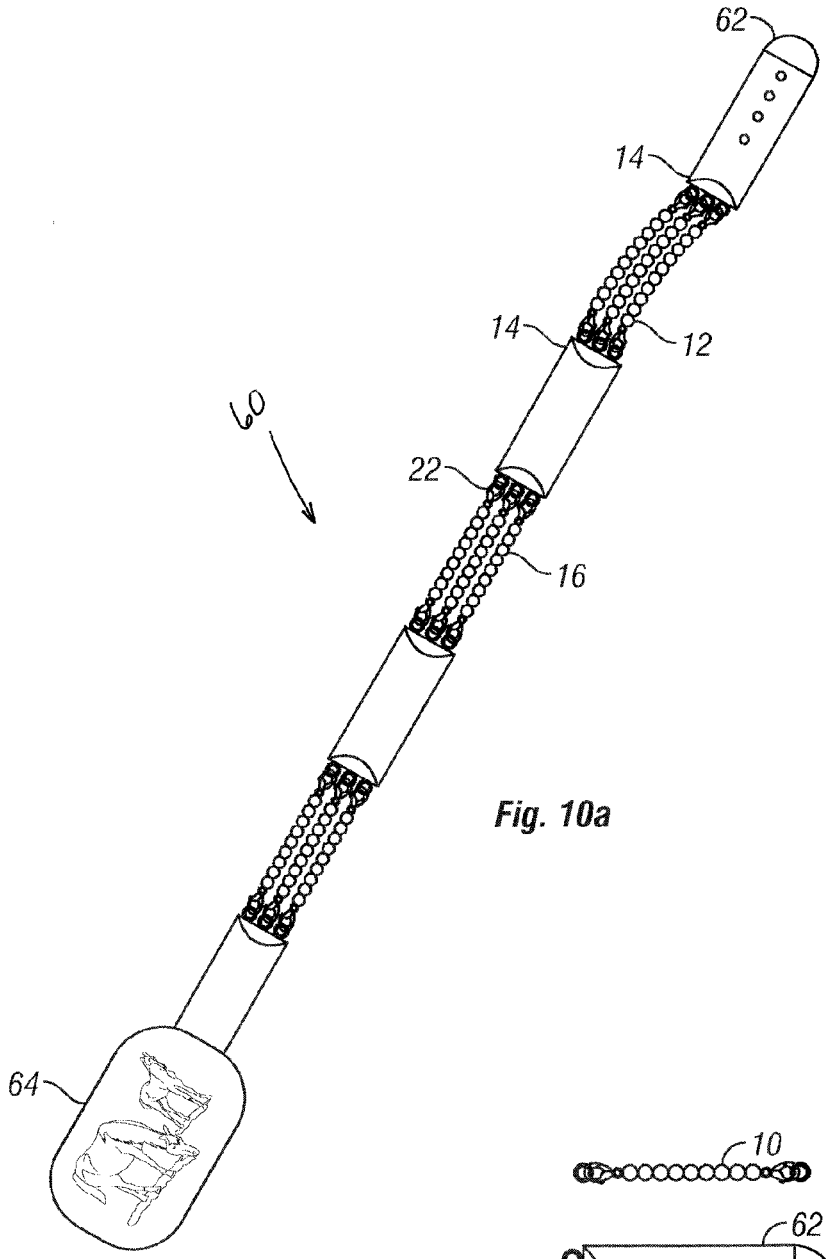
FIGS. 10*a* and *b* illustrate belt embodiments of the present invention.
Figure 10B:
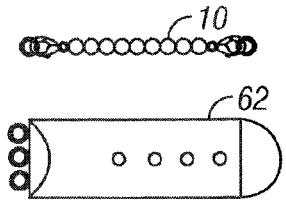

FIGS. 10*a* and *b* illustrate belt 60 which preferably comprises belt end 62 with opening and/or recess within which one or more bars 14 preferably extend. Bars 14 can be moveably or fixedly attached to a belt end 62 and/or buckle 64, such that strands 10 can be placed and/or woven between bars 14. Custom belt 60 preferably comprises a plurality of interchangeable strands 10. Belt buckle 64 can comprise any buckle and preferably has a bar and or clasps (not shown) on the back side for attachment to belt end 62. Belt 60 can be fixed and/or adjustable in width and length. A plurality of strand/bar combinations are arranged to form the belt. As those skilled in the art will readily recognize, linking together members of strand 10 and bar 14 combinations can create virtually any shape and/or style of jewelry, particularly flexible jewelry pieces. Strand/bar combinations can optionally be changed and moved between different articles of clothing.

Various components of the alternative embodiments of this invention can be provided in pre-designed or custom packages or kits. For example, a necklace package or kit could optionally comprise one or more elongated chains, sliding and/or adjustable elements, beads, stones, hoops, bars and strands.

INDUSTRIAL APPLICABILITY

The invention is further illustrated by the following non-limiting example.

Example 1

Jewelry Kit (Earrings/Bracelet)

Jewelry was made using the following:
6 inch strands:
1 green turquoise with 8 mm round beads
1 green pink coral with 8 mm square settings
2 bracelet bars with extender chain
2 earring bars
2 French ear wires Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A method of constructing a jewelry necklace comprising at least three jewelry strands and interchanging or replacing or removing the strands of the necklace to construct a different jewelry necklace, the method comprising:

providing two separate bars for attaching ends of the jewelry strands, each bar comprising a planar surface with a row of openings, the openings on the first bar corresponding to the openings on the second bar, the openings disposed perpendicular to the planar surfaces of the bars, and the openings on the first bar disposed in an opposing and corresponding diagonal row with respect to the row of openings on the second bar;

providing at least three jewelry strands of the same length, each jewelry strand comprising a first end and a second end, and each end of the jewelry strands comprising a clasp for attaching to the openings in the bars;

attaching the first end of the first jewelry strand to the first bar at a first opening in the first bar via the clasp at the first end of the first jewelry strand;

attaching the second end of the first jewelry strand to the second bar at a corresponding first opening in the second bar via the clasp at the second end of the first jewelry strand;

attaching the first end of the second jewelry strand to the first bar at a second opening in the first bar via the clasp at the first end of the second jewelry strand;

attaching the second end of the second jewelry strand to the second bar at a corresponding second opening in the second bar via the clasp at the second end of the second jewelry strand;

attaching the first end of the third jewelry strand to the first bar at a third opening in the first bar via the clasp at the first end of the third jewelry strand;

attaching the second end of the third jewelry strand to the second bar at a third corresponding opening in the second bar via the clasp at the second end of the third jewelry strand;

when the jewelry necklace is constructed, the jewelry strands nest coplanarly due to the jewelry strands having the same lengths and their attachment to the diagonal corresponding and opposing rows of openings in the bars; and interchanging, removing and/or replacing any of the first, second and/or third or more interchangeable jewelry strands on the bars via the corresponding openings in the bars in order to construct a different and interchangeable jewelry necklace.

2. A jewelry kit for constructing a jewelry necklace comprising at least three interchangeable jewelry strands comprising:

two separate bars for attaching ends of at least three jewelry strands, each bar comprising a planar surface with a row of openings, the openings on the first bar corresponding to the openings on the second bar, the openings disposed perpendicular to the planar surfaces of said bars, and the openings on the first bar disposed in an opposing and corresponding diagonal row with respect to the row of openings on the second bar; and at least three interchangeable jewelry strands of the same length, each jewelry strand comprising a first end and a second end, and each end of the jewelry strands comprising a clasp for attaching to the openings in the bars;

the first end of the first jewelry strand attachable to the first bar at a first opening in the first bar via the clasp at the first end of the first jewelry strand;

the second end of the first jewelry strand attachable to the second bar at a corresponding first opening in the second bar via the clasp at the second end of the first jewelry strand;

the first end of the second jewelry strand attachable to the first bar at a second opening in the first bar via the clasp at the first end of the second jewelry strand;

the second end of the second jewelry strand attachable to the second bar at a corresponding second opening in the second bar via the clasp at the second end of the second jewelry strand;

the first end of the third jewelry strand attachable to the first bar at a third opening in the first bar via the clasp at the first end of the third jewelry strand;

the second end of the third jewelry strand attachable to the second bar at a third corresponding opening in the second bar via the clasp at the second end of the third jewelry strand;

when the jewelry necklace is constructed, the jewelry strands nest coplanarly due to the jewelry strands having the same lengths and their attachment to the diagonal corresponding and opposing rows of openings in the bars.

3. The jewelry kit of claim 2 wherein each of said interchangeable jewelry strands comprises a plurality of beads and/or elastic.

4. The jewelry kit of claim 2 further comprising a chain for connecting said bars, said chain for supporting the jewelry necklace around a user's neck.

5. A jewelry necklace comprising:

two separate bars for attaching ends of at least three jewelry strands, each bar comprising a planar surface with a row of openings, the openings on the first bar corresponding to the openings on the second bar, the openings disposed perpendicular to the planar surfaces of said bars, and the openings on the first bar disposed in an opposing and corresponding diagonal row with respect to the row of openings on the second bar; and at least three interchangeable jewelry strands of the same length, each jewelry strand comprising a first end and a second end, and each end of the jewelry strands comprising a clasp for attaching to the openings in the bars;

the first end of the first jewelry strand removeably attached to the first bar at a first opening in the first bar via the clasp at the first end of the first jewelry strand;

the second end of the first jewelry strand removeably attached to the second bar at a corresponding first opening in the second bar via the clasp at the second end of the first jewelry strand;

the first end of the second jewelry strand removeably attached to the first bar at a second opening in the first bar via the clasp at the first end of the second jewelry strand;

the second end of the second jewelry strand removeably attached to the second bar at a corresponding second opening in the second bar via the clasp at the second end of the second jewelry strand;

the first end of the third jewelry strand removeably attached to the first bar at a third opening in the first bar via the clasp at the first end of the third jewelry strand;

the second end of the third jewelry strand removeably attached to the second bar at a third corresponding opening in the second bar via the clasp at the second end of the third jewelry strand;

wherein the jewelry strands nest coplanarly due to the jewelry strands having the same lengths and their attachment to the diagonal corresponding and opposing rows of openings in the bars.

6. The jewelry necklace of claim 5 wherein each of said interchangeable jewelry strands comprises a plurality of beads and/or elastic.

7. The jewelry necklace of claim 5 further comprising a chain connecting said bars, said chain for supporting the jewelry necklace around a user's neck.

* * * * *